US007237463B1

(12) United States Patent
Lee

(10) Patent No.: US 7,237,463 B1
(45) Date of Patent: Jul. 3, 2007

(54) BENDABLE WRENCH

(76) Inventor: Yi Min Lee, P.O. Box 2568 Taichung, Taichung City (TW) 40099

( * ) Notice: Subject to any disclaimer, the term of this patent is extended or adjusted under 35 U.S.C. 154(b) by 0 days.

(21) Appl. No.: 11/439,735

(22) Filed: May 24, 2006

(51) Int. Cl.
*B25B 23/16* (2006.01)
*B25G 1/00* (2006.01)

(52) U.S. Cl. ..... 81/177.8; 81/177.7

(58) Field of Classification Search ..... 81/177.6–177.8
See application file for complete search history.

(56) References Cited

U.S. PATENT DOCUMENTS 2,921,773 A * 1/1960 Hoelzer ..... 254/129
4,929,113 A * 5/1990 Sheu ..... 403/157
5,581,838 A * 12/1996 Rocco ..... 15/110
5,820,288 A * 10/1998 Cole ..... 403/97
5,943,925 A * 8/1999 Huang ..... 81/177.2
6,148,698 A * 11/2000 Hsieh ..... 81/177.8
6,186,033 B1 * 2/2001 Faro, Sr. ..... 81/177.7
6,848,344 B2 * 2/2005 Rocco ..... 81/177.8

* cited by examiner

*Primary Examiner*—David B. Thomas
(74) *Attorney, Agent, or Firm*—Banger Shia

(57) ABSTRACT

A bendable wrench includes a handle, a head and a pivot. The handle includes a first ear formed thereon, a second ear formed thereon and a plurality of teeth formed on an internal side of the second ear. The head includes an ear and a plurality of teeth formed on an internal side of the ear thereof. The pivot is movably inserted in the ears so as to pivotally connect the head to the handle. The pivot includes a plurality of teeth that can be engaged with the teeth so as to firmly retain the angle between the head and the handle and disengage from the teeth of the head so that the angle between the head and the handle can be changed.

5 Claims, 5 Drawing Sheets

BENDABLE WRENCH

BACKGROUND OF INVENTION

1. Field of Invention

The present invention relates to a bendable wrench and, more particularly, to a connecting device for connecting a head to a handle of a bendable wrench so that the angle between the head and the handle can be changed in a large range and firmly retained.

2. Related Prior Art

Wrenches are often used to tighten and slacken fasteners such as threaded bolts and nuts. Wrenches include one-way wrenches, socket wrenches, open-ended wrenches and box-ended wrenches. A wrench includes a handle and at least one head provided at an end of the handle. To fit in a limited and crooked working environment, there have been devised bendable wrenches such as disclosed in Taiwanese Patent Publication Nos. 450185 and 569860 and Taiwanese Patents I241940 and I242483. Such a bendable wrench includes a handle, a head and a connecting device for connecting to the head to the handle so that the angle between the head and the handle can be changed and retained. There are however problems with these conventional bendable wrenches. Firstly, they include complicate structures made of many components. It is troublesome to make and assemble these components. Secondly, to change the angle between the head and the handle, a user has to operate the connecting device with one hand and change the angle with the other hand, and this is inconvenient. Thirdly, the angle can be changed between only a few pre-determined values. Fourthly, the angle cannot firmly be retained in operation, and this not only interrupts the operation but also imposes a potential danger to the user.

The present invention is therefore intended to obviate or at least alleviate the problems encountered in prior art.

SUMMARY OF INVENTION

It is an objective of the present invention to provide a structurally simple bendable wrench.

It is another objective of the present invention to provide a bendable wrench with a handle and a head that can easily be switched between various angular positions on the handle.

It is another objective of the present invention to provide a bendable wrench with a handle and a head that can be switched between many angular positions on the handle.

It is another objective of the present invention to provide a bendable wrench with a handle and a head that can firmly be retained in desired one of various angular positions on the handle.

According to the present invention, a bendable wrench includes a handle, a head and a pivot. The handle includes a first ear formed thereon, a second ear formed thereon and a plurality of teeth formed on an internal side of the second ear. The head includes an ear and a plurality of teeth formed on an internal side of the ear thereof. The pivot is movably inserted in the ears so as to pivotally connect the head to the handle. The pivot includes a plurality of teeth that can be engaged with the teeth so as to firmly retain the angle between the head and the handle and disengage from the teeth of the head so that the angle between the head and the handle can be changed.

Other objectives, advantages and features of the present invention will become apparent from the following description referring to the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
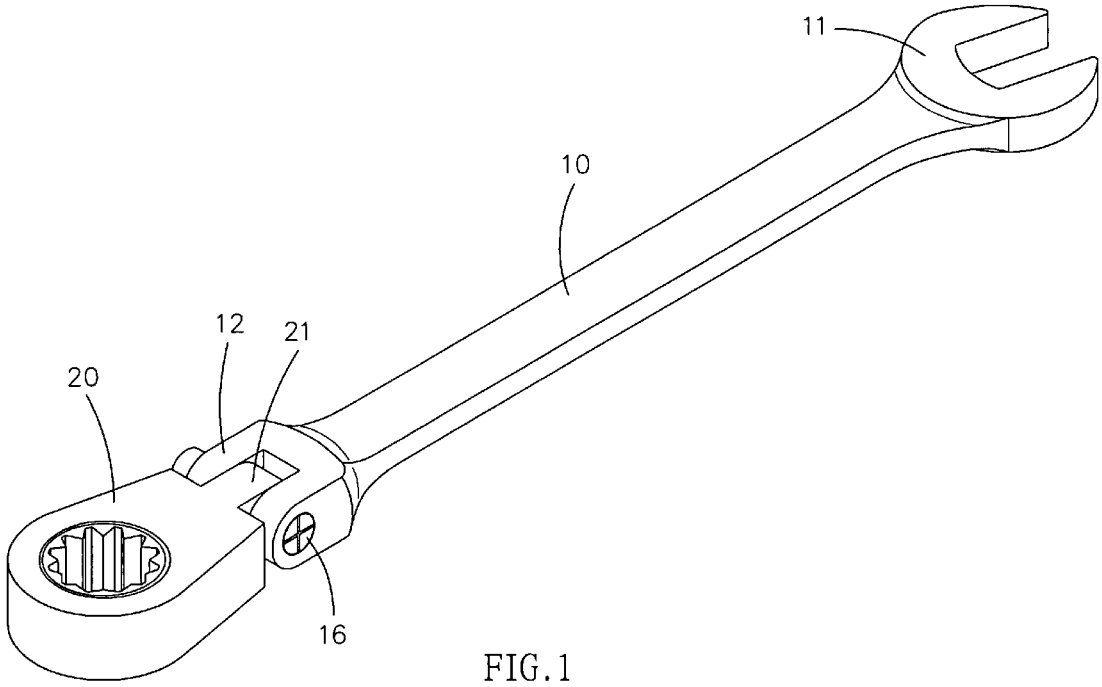
FIG. 1 is a perspective view of a bendable wrench according to the preferred embodiment of the present invention.
Figure 2:
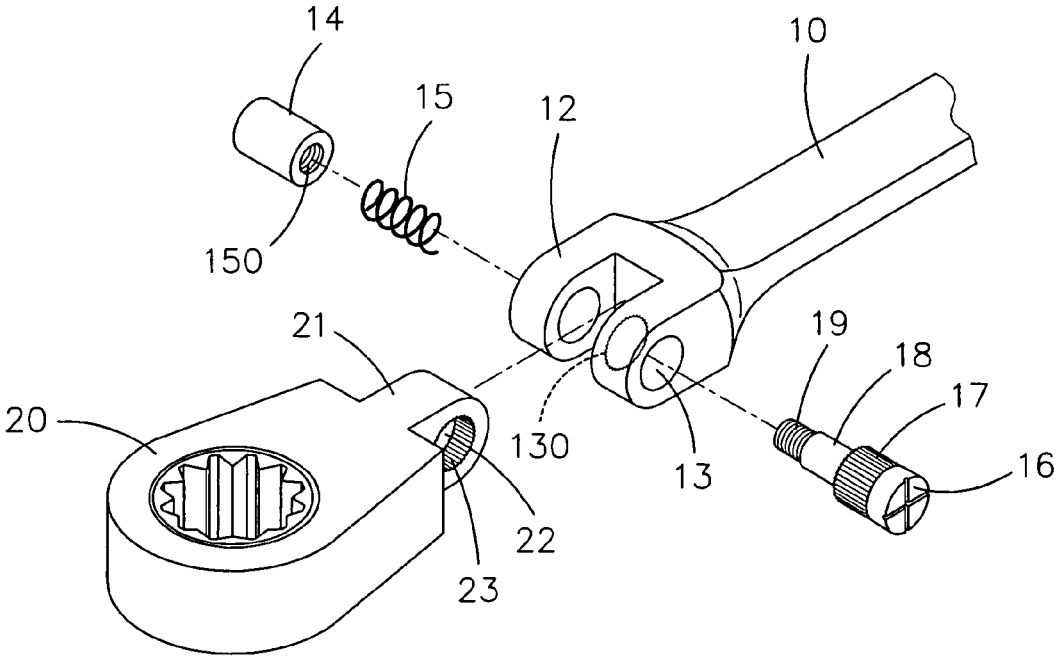
FIG. 2 is an exploded partial view of the bendable wrench shown in FIG. 1.

Referring to FIGS. 1 and 2, there is shown a bendable wrench in accordance with the preferred embodiment of the present invention. The bendable wrench includes a handle 10 formed with an open end 11 and a head 20 pivotally connected to the other end of the handle 10. The angle between the head 20 and the handle 10 can easily changed and firmly retained. The handle 10 may include a box end in another embodiment. The head 20 may be an open end, a box end, a money wrench head or a selective one-way wrench head.

The handle 10 includes two ears 12 formed at the end opposite to the open end 11. Each of the ears 12 defines an aperture 13. A plurality of teeth 130 is formed on the wall of the aperture 13 of one of the ears 12. The teeth 130 may extend only a portion of the axial length of the wall of the aperture 13 of the ear 12.

The head 20 includes an ear 21 formed at an end. The ear 21 defines an aperture 22. A plurality of teeth 23 is formed on the wall of the aperture 22. The teeth 23 may extend only a portion of the axial length of the wall of the aperture 22 of the hear 21.

There is provided a connecting device for pivotally connecting the head 20 to the handle 10. The connecting device includes a pivot 16, a spring 15 and a button 14.

The pivot 16 includes a plurality of teeth 17 formed thereon, a smooth reduced shank 18 formed next to the teeth 17 and a thread 19 formed next to the smooth reduced shank 18.

The spring 15 may be a helical compression spring.

The button 14 is like a nut, i.e., it includes a thread 150 formed on an internal side.

Figure 3:
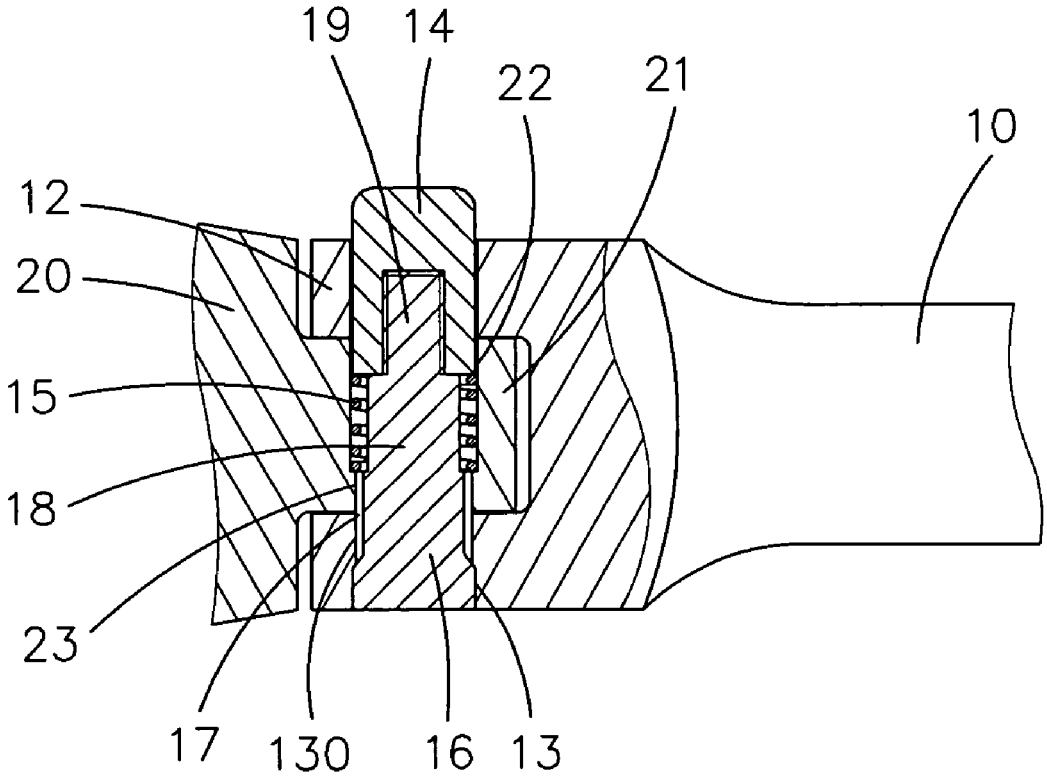
FIG. 3 is a cross-sectional partial view of the bendable wrench shown in FIG. 1.

In assembly, the ear 21 is positioned between the ears 12 so that the aperture 22 is aligned with the apertures 13. The pivot 16 is inserted in the apertures 13 and 22. The spring 15 is positioned in the apertures 13 and 22 around the shank 18 against the teeth 23 (FIG. 3). The thread 150 is engaged with the thread 19. Now, the bendable wrench is assembled. The spring 15 is compressed between the teeth 23 and the button 14.

Referring to FIG. 3, because of the spring 15, the teeth 17 are engaged with the teeth 130 and 23 so that the angle between the head 20 and the handle 10 is firmly retained.

Figure 4:
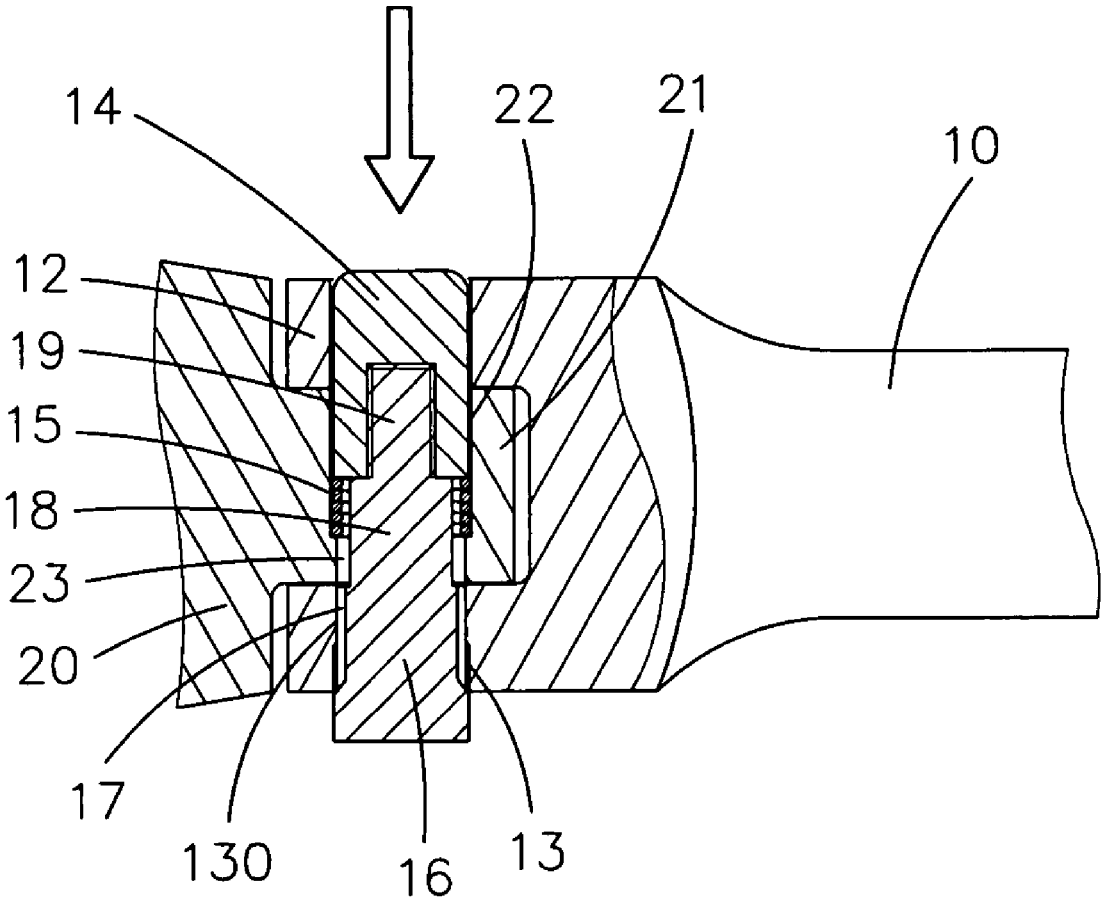
FIG. 4 is a cross-sectional view of the bendable wrench in another position other than shown in FIG. 3.

Referring to FIG. 4, the button 14 is pushed against the spring 15 so that the teeth 17 are disengaged from the teeth 23. Thus, the angle between the head 20 and the handle 10 can be changed.

Figure 5:
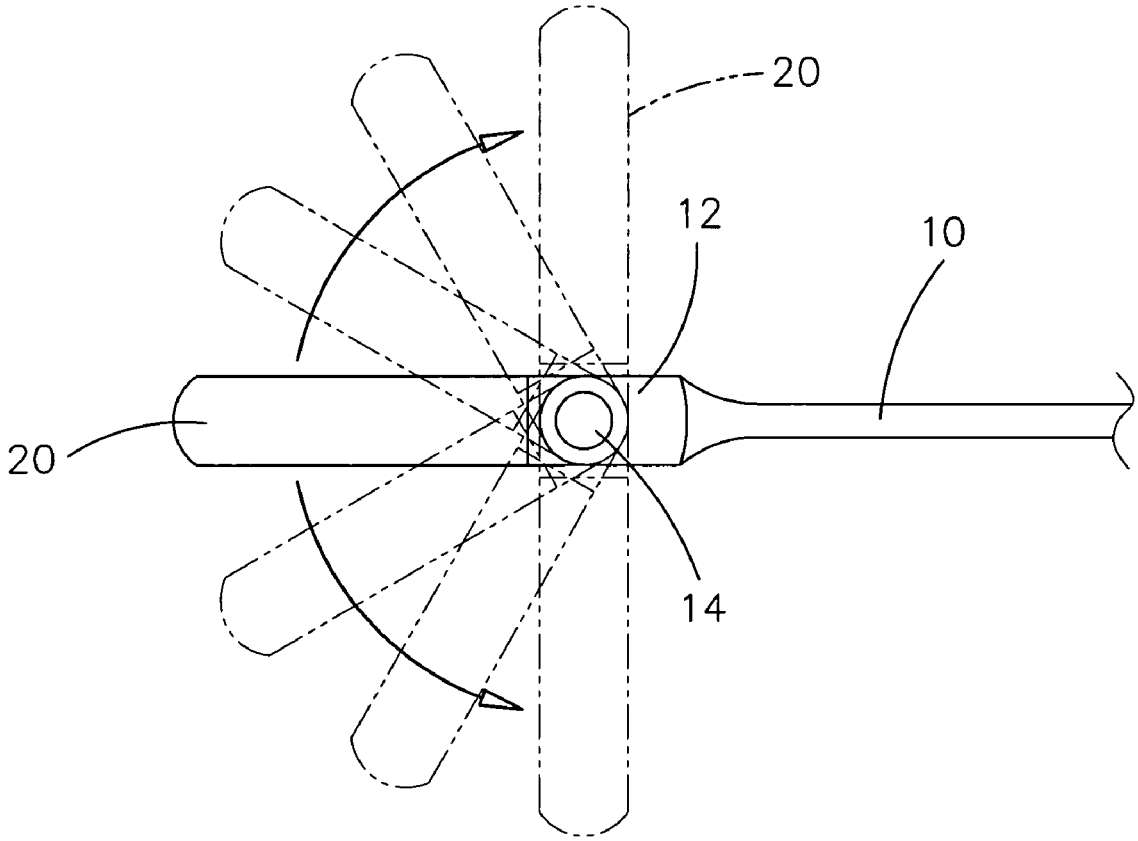
FIG. 5 is a side partial view of the bendable wrench of FIG. 1.

Referring to FIG. 5, the angle between the head 20 and the handle 10 can be changed within a large range for using of a lot of teeth 130 and 23.

In another embodiment, the handle 10 may include a single ear like the ear 21, and the head 20 may include two ears like the ears 12.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A bendable wrench comprising:

a handle comprising a first ear formed thereon, a second ear formed thereon and a plurality of teeth formed on an internal side of the second ear so that the teeth extend for only a portion of the thickness of the second ear;

a head comprising an ear and a plurality of teeth formed on an internal side of the ear thereof;

a pivot movably inserted in the ears so as to pivotally connect the head to the handle, the pivot comprising a plurality of teeth that can be engaged with the teeth so as to firmly retain the angle between the head and the handle and disengage from the teeth of the head so that the angle between the head and the handle can be changed.

2. The bendable wrench according to claim 1 comprising a button attached to the pivot.

3. The bendable wrench according to claim 2 wherein the button comprises a thread formed on an internal side, wherein the pivot comprises a thread formed thereon for engagement with the thread of the button.

4. The bendable wrench according to claim 2 comprising a spring compressed between the button and the teeth of the ear of the head.

5. The bendable wrench according to claim 1 wherein the teeth of the head extend for only a portion of the thickness of the ear of the head.

* * * * *